US007841022B2

(12) United States Patent
Chang

(10) Patent No.: US 7,841,022 B2
(45) Date of Patent: Nov. 30, 2010

(54) GARMENT HAVING VARIOUS FUNCTIONAL FINISHES

(75) Inventor: Jason Chang, Zibo (CN)

(73) Assignee: Luthai Textile Co., Ltd., Shandong Province (CN)

( * ) Notice: Subject to any disclaimer, the term of this patent is extended or adjusted under 35 U.S.C. 154(b) by 143 days.

(21) Appl. No.: 12/173,182

(22) Filed: Jul. 15, 2008

(65) Prior Publication Data

US 2010/0011482 A1 Jan. 21, 2010

(51) Int. Cl.
*A41B 1/00* (2006.01)

(52) U.S. Cl. ..... 2/115; 2/77

(58) Field of Classification Search ..... None
See application file for complete search history.

(56) References Cited

U.S. PATENT DOCUMENTS

2006/0228964 A1* 10/2006 Watkins et al. ..... 442/94

2008/0138599 A1* 6/2008 Gao et al. ..... 428/221

* cited by examiner

*Primary Examiner*—Gary L Welch
*Assistant Examiner*—Amber R Anderson
(74) *Attorney, Agent, or Firm*—Leydig, Voit & Mayer, Ltd.

(57) ABSTRACT

A garment, particularly a shirt, is made from a number of fabric portions which are sewn together, each of the portions having different performance characteristics. The front of the shirt is finished so as to be stain-resistant with a chemical water- and oil-repellent finish. To mitigate moisture accumulation on the wearer's skin, the back and sleeves are treated with an absorbency-enhancing finish, the collar and cuffs having a soil-release finish. In manufacture, the different portions are cut from differently treated sections of a mill run of fabric, the sections being processed under constant conditions so that the different sections have consistent shrinkage properties and colours.

15 Claims, 2 Drawing Sheets

GARMENT HAVING VARIOUS FUNCTIONAL FINISHES

TECHNICAL FIELD

Figure 1:
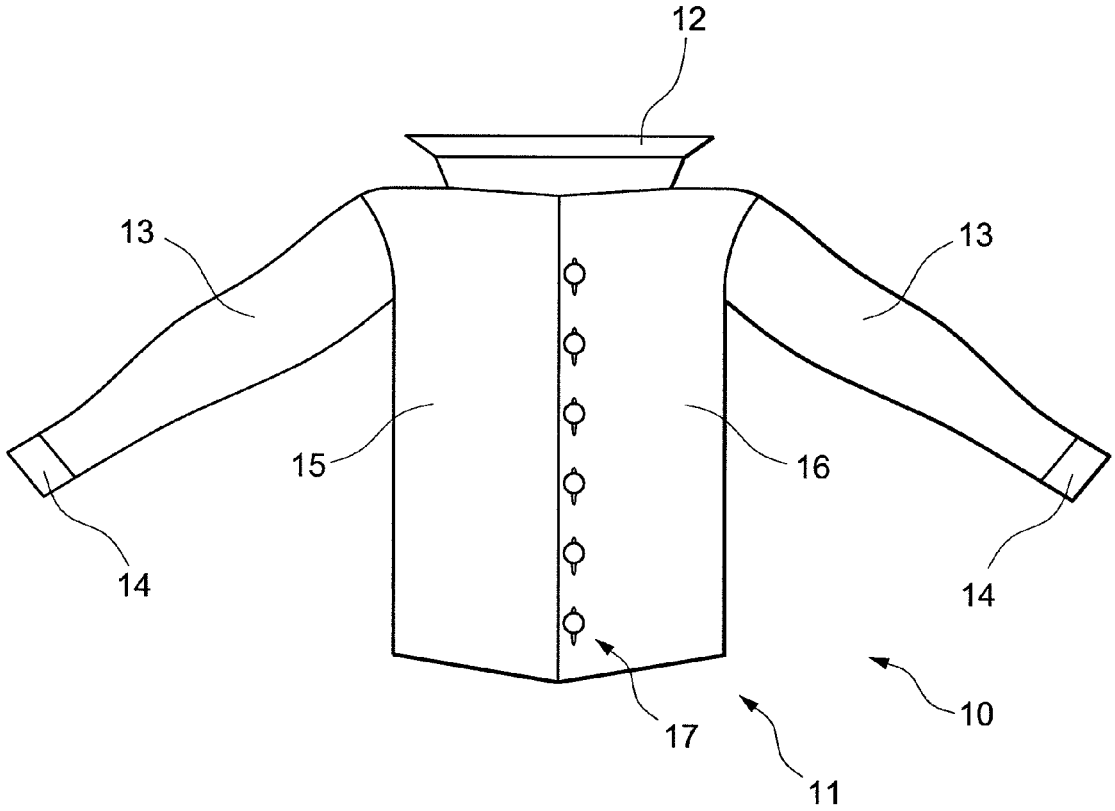

This invention relates to a garment having different performance characteristics in different areas and to a method of manufacture of the same. In particular, the invention relates to a garment having a front portion with a water-repellent and oil-repellent finish and other portions having other functional finishes.

BACKGROUND OF THE INVENTION

The performance demands on garments such as shirts are varied. When going out for a meal diners will occasionally end up spilling food down the front of their shirts. To avoid embarrassment it is particularly important that such spills can be readily cleaned up, for instance using a napkin or the like, without staining. For comfort, the shirt should mitigate the accumulation of moisture on the skin of the wearer; the collar and cuffs, which are unavoidably soiled in use, must be readily laundered, and the garment should have and retain a good appearance. All of these properties should be retained through a reasonable number of washes. Prior art shirts have not satisfactorily addressed all of these requirements.

Water and oil repellency are generally attained in absorbent fabric applications either by hydrophobic polymer films or by the attachment, chemically or physically, of hydrophobic species to the fibres of the fabric. Compared to polymeric coatings, the hydrophobic species can penetrate within the fabric to produce a more durable coating. These finishes help to reduce the tendency of soil, oil, and water to adhere to the fibres and so prevent staining. However, these treatments also reduce the ability of the fabric to absorb and wick moisture away from the skin and so shirts made of fabrics treated for water and oil repellency are uncomfortable to wear.

Natural fibres such as cotton have little water and oil repellency, but when soiled, they are fairly readily cleaned, thus exhibiting a degree of soil releasability. Hydrophilic soil release polymers are used to treat fabrics to increase soil releasability. For good appearance the fabric of a shirt should also have wrinkle-free properties finish (also known as "easy care", "durable press", "wrinkle-resistant", "wash and wear", "non-iron" etc) and a number of agents are known for treating fabrics so that they retain a smooth appearance.

One method for treating fabrics to simultaneously impart both oil- and water-repellent components and soil release characteristics has been to use copolymers containing fluorocarbon oil- and water-repellent components and hydrophilic soil release components. However the resulting oil and water repellency is lower than that obtained with fluorochemical treatments and for shirts their soil release properties are not sufficiently wash-durable.

A shirt is assembled from a number of different portions or panels, including the front, back, sleeves, cuffs and collar, and these portions must be accurately colour matched. To maintain proper shape of a shirt these portions should also possess consistent shrinkage properties. When manufacturing a technical garment such as that used for outdoor sports different appearances of the different portions of the garment are highlighted as design elements, however this cannot be done in a shirt. Therefore it will be understood that there is a need when manufacturing a shirt from portions with different performance characteristics then these issues of colour and shrinkage variation must be addressed.

DISCLOSURE OF THE INVENTION

According to one aspect of the present invention there is provided a garment made from a natural fibre fabric comprising:

a front and a back portion for covering opposing sides of a wearer's torso, the front portion having a water-repellent and oil-repellent finish;

a pair of sleeve portions, the back portion and each of the sleeve portions having an absorbency-enhancing finish;

a collar portion, and a cuff portion fixed to each of the sleeve portions, the collar portion and each cuff portion having a soil-release finish.

Preferably the front portion has a finish is selected from one or more of fluorochemical, pyridinium, carboxymethyl and organosilicone water-repellent and oil-repellent finishes, the back portion and each of the sleeve portions have a hydroxyl ethyl amine absorbency-enhancing finish and the collar portion and each cuff portion organic fluorinated polyacrylate soil-release finish.

Preferably the fabric is a knitted fabric or a woven fabric. The fabric is preferably made from cotton, or a blend of cotton and synthetic fibres.

Preferably the front and back portions, sleeve portions, cuff portions and collar portion further includes a dihydroxymethyl cyclic urea wrinkle-free finish.

In another aspect the invention provides a method of manufacturing a garment, comprising:

a) conveying first, second and third lots of grey fabric through like singeing, desizing, scouring bleaching and mercerizing processes;

b) holding the first lot in a stretched condition on a tentering means and applying a water-repellent and oil-repellent treatment to the first lot;

c) holding the second lot in a stretched condition on a tentering means and applying an absorbency-enhancing treatment to the second lot;

d) holding the third lot in a stretched condition on a tentering means and applying a soil-release treatment to the third lot;

e) curing and drying the first, second and third lot;

f) cutting, from the first lot, a front portion of a garment for covering a front side of a wearer's torso;

g) cutting, from the second lot, a pair of sleeve portions and a back portion of a garment for covering a back side of a wearer's torso;

h) cutting, from the third lot, a collar portion and a pair of cuff portions, and i) sewing together the front and back portions, sleeve portions, cuff portions and collar portion to form the garment.

Optionally the method may include dividing the length of fabric to separate the first, second and third lots following step a) and wherein steps b), c) and d) are performed in respective tentering means.

Preferably the method further includes: holding the first, second and third lots in a stretched condition on a tentering means and applying a wrinkle-free treatment to each of the first, second and third lots.

Preferably the treatments are provided by saturation or impregnation in an aqueous treatment liquor.

Preferably the water-repellent and oil-repellent treatment is selected from compositions containing fluorochemicals, pyridinium compounds, carboxymethyl compounds and organosilicone compounds.

Preferably the absorbency-enhancing treatment is an aqueous composition containing hydroxyl ethyl amine. Preferably the soil-release organic treatment is a composition containing organic fluorinated polyacrylates.

Preferably step e) is performed by conveying the lots sequentially through the same one or more ovens under substantially constant process conditions.

Testing has shown that the accumulation of moisture on the skin of the wearer is substantially mitigated by a garment according to the invention, making the garment considerably more comfortable to wear than prior art garments having a water-repellent and oil-repellent front. Perspiration in liquid form is repelled by the treated fabric and prevented from passing through the fabric, however, pores remain in the fabric and the flow of perspiration vapour through the fabric is not prevented. Although the exact mechanism by which the improved comport is achieved has not been determined, it is theorised that a synergistic effect is achieved due a net increase in absorbency, since the moisture absorbency of the cuffs and collar is generally alike that of the untreated fabric, while that of the sleeves and back is increased.

BRIEF DESCRIPTION OF THE DRAWING FIGURES

Figure 2:
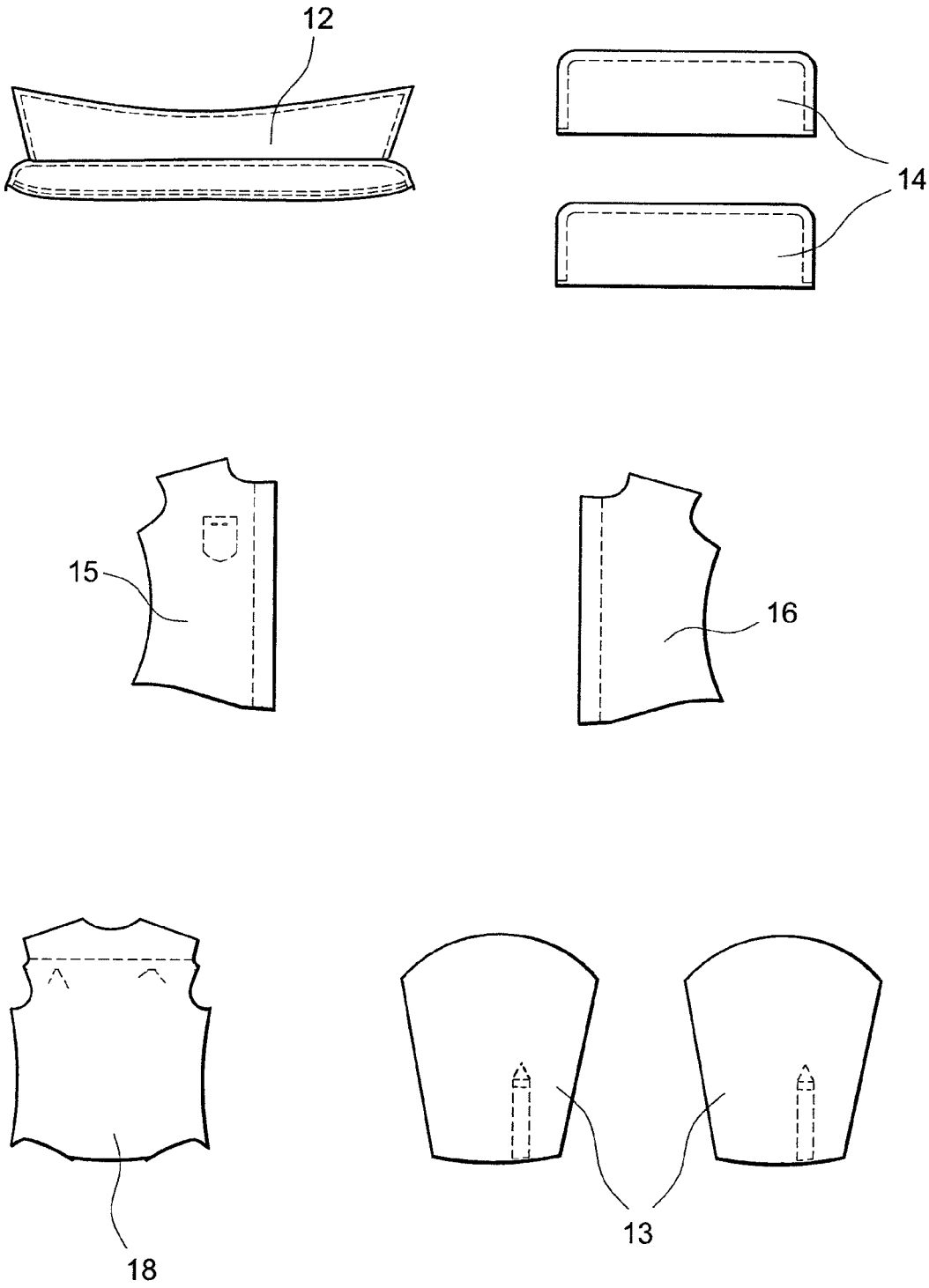

FIGS. 1 and 2 show preferred embodiments of garments according to the invention.

DESCRIPTION OF THE PREFERRED EMBODIMENTS

Referring to FIGS. 1 and 2, a preferred embodiment of shirt 10 or blouse that comprises body portion 11 for covering opposing sides of a wearer's torso, collar portion 12, a pair of sleeve portions 13, and a cuff portion 14 fixed to each of the sleeve portions. Preferably, portions 11-14 are made of yarn-dyed woven fabric and joined by sewing or other conventional processes. Each of the portions is preferably fabricated from a knitted fabric or a woven fabric made from 100% cotton fibres.

In a preferred embodiment, front of the body portion 12 includes left and right front portions 15, 16 releasably connected by arrays of buttons and button holes 17 of for covering the front sides of a wearer's torso. A back portion 18 of the body portion 12 covers the wearer's back in use. The left and right front portions 15, 16 have a water-repellent and oil-repellent finish. Preferably the finish is attained by the aqueous application of a fluorochemical water and oil-repellent composition as described below. Other categories of repellents based on hydrophobic species may alternatively be used, including aluminum and zirconium soaps, metal complexes, pyridinium compounds and methylol compounds.

The back portion 18 and each of the sleeve portions 13 having an absorbency-enhancing finish. Preferably the absorbency-enhancing finish is attained by the aqueous application of an absorbency-enhancing composition including paraffin and hydroxyl ethyl amine as described below. Other categories of absorbency-enhancing may also be used, including amino organosilocone containing a moisture-absorbing group.

The collar portion and each cuff portion have a soil-release finish. Preferably the soil-release finish is attained by the aqueous application of an organic fluorinated polyacrylate soil-release composition as described below. Other categories of absorbency-enhancing may alternatively be used, including carboxylic acid containing copolymers, sulfonic acid containing copolymers, ethoxylated polyesters, certain polyacrylamide polymers and certain cellulose derivatives.

All of the portions 12-18 are also treated chemically to provide a wrinkle-free finish. The wrinkle-free finish (also known as "easy care", "durable press", "wash and wear", "non-iron" etc) may be obtained by forming cross-links between adjacent cellulose polymer chains in the cotton, these give cotton some elastic and resilient properties. Such cross-linked cotton can recover from deformation stresses and thus wrinkles will not form. Preferably the wrinkle-free finish is attained by the aqueous application of a catalysed dihydroxymethyl cyclic urea composition as described below. Other categories of absorbency-enhancing may alternatively be used, including polycarboxlic acids, citric acid and polymers of maleic acid.

Finishing changes the appearance, the hand, and the performance of the grey fabric (the fabric in its natural state). The preparation stage of finishing involves the conventional steps of singeing, desizing, scouring, bleaching, and mercerization. Singeing is used to remove lint, while desizing, scouring and bleaching removes all of the impurities, such as sizing agents, oil and dirt, from the grey fabric. Mercerization is the action of a strong alkali on the fabric that opens the cotton fibers to increase lustre, softness, and the overall dye affinity. In final finishing chemicals and processes are used to impart functional attributes to a fabric that are not inherently present via the raw materials being used. The term "finish" refers to the fabric as coated or impregnated with chemical agents to provide these properties which are improved relative to the natural fabric. Following application of the chemical treatments the fabric is cured, straightened and dried by tentering. These processes are applicable to both piece dyed and yarn dyed fabrics.

In the preferred method, one mill run length of fabric is processed, under substantially constant conditions in the same equipment, successively through singeing, desizing, scouring, bleaching and mercerization, preferably liquid ammonia mercerization.

To apply a wrinkle-free finish, the length of fabric is placed in a tentering machine in which the wrinkle-free agent is firstly applied by saturation or impregnation. Preferably the agent is an aqueous liquor of modified dihydroxymethyl cyclic urea, an acidic metal salt catalyst, a polyethylene fibre-protecting agent and an amino-modified low yellowing organic silicon softener. The agent is then cured, passing the fabric being conveyed on the tentering machine through an oven at elevated temperature (e.g. 170 deg C. for two minutes). Curing is followed by a water wash.

Three different sections of the length of fabric each then undergo a respective penetrating chemical finishing treatment followed by oven curing and drying to impart different finishes to each of these sections. The lot size of the sections are determined in proportion to the weight of the different components in a shirt. The three treatments are preferably performed successively in one tentering machine and under processing conditions that differ only by the different chemical finishing composition applied to each section, but where degrees of stretch, temperatures and processing times are otherwise alike. It has been found that this procedure substantially mitigates colour variation between the three sections and provides consistent shrinkage properties between the sections.

The first section is mounted on the tentering machine in which a water-repellent and oil-repellent agent is applied, as by drawing the first section through a bath. Preferably the agent is an aqueous liquor of pyridinium-type water repellent and organic fluorinated water repellent.

An absorbency-enhancing agent is applied to the second section when it is held in a stretched condition on the tentering machine. The absorbency-enhancing agent is preferably an aqueous liquor of paraffin and hydroxyethyl amine.

A soil-release treatment is applied to the third section. The soil-release agent is preferably an aqueous liquor including an organic fluorinated polyacrylate.

In preferred embodiments, other additives and auxiliaries such as dispersants, thickeners, ultraviolet light stabilizers, and the like may be added to any of the three treatment compositions.

Following the application of the treatment compositions, the sections are conveyed on the tentering machine through a curing oven (e.g. at a temperature of 150 deg C. for 3 minutes). The sections are then conveyed through a pre-shrinking oven for pre-shrinking (e.g. at a temperature of 100 deg C. for 10 minutes).

During cutting, the left and right front portions 15, 16 are cut from the first section, the pair of sleeve portions 13 and the back portion 18 are cut from the second section and the collar portion and cuff portions 12, 14 are cut from the third section. The portions 12-18 may also be colour graded according to usual practice to ensure a very high standard of colour consistency, before finish sewing to complete the garment.

As those familiar with textile technologies will be aware, the above-described processes for applying chemical finishes to fabrics are known in the art and they impart the requisite of water-repellency and oil-repellency, absorbency-enhancing, soil-release and wrinkle-free properties with satisfactory wash durability. The wrinkle-free treatments are also compatible with the three other treatments to the extent that they provide improvements in water- and oil-repellency, absorbency, and soil-releasability relative to untreated cotton fabric when applied subsequently to the wrinkle-free treatment.

In a particularly preferred embodiment, the shirt 10 is provided with sharp creases that are durable for the life of the garment. To achieve this, an interlining is sewn to the relevant portions following cutting. After finish sewing of the shirt 10 creases are pressed into the garment. A high temperature cure in this configuration activating cross-linking in a resin within the interlining.

Aspects of the present invention have been described by way of example only and it should be appreciated that modifications and additions may be made thereto without departing from the scope thereof.

The invention claimed is:

1. A method of manufacturing a garment, comprising:

a) conveying first, second, and third lots of greige fabric through singeing, desizing, scouring, bleaching, and mercerizing processes;

b) holding the first lot in a stretched condition on tentering means and applying a water-repellent and oil-repellent treatment to the first lot;

c) holding the second lot in a stretched condition on tentering means and applying an absorbency-enhancing treatment to the second lot;

d) holding the third lot in a stretched condition on tentering means and applying a soil-release treatment to the third lot;

e) curing and drying the first, second, and third lots;

f) cutting, from the first lot, a front portion of a garment for covering a front side of a wearer's torso;

g) cutting, from the second lot, a pair of sleeve portions and a back portion of a garment for covering a back side of a wearer's torso;

h) cutting, from the third lot, a collar portion and a pair of cuff portions, and i) sewing together the front and back portions, the sleeve portions, the cuff portions and the collar portion to form the garment.

2. The method of claim 1 further including holding the first, second, and third lots in a stretched condition on tentering means and applying a wrinkle-free treatment to each of the first, second, and third lots.

3. The method of claim 2 including applying a composition including dihydroxymethyl cyclic urea as the wrinkle-free treatment.

4. The method of claim 1 including applying the water-repellent and oil-repellent absorbency-enhancing, the absorbing-enhancing, and soil-release treatments by saturation or impregnation in an aqueous treatment liquor.

5. The method of claim 1 including applying a composition containing compounds selected from the group consisting of fluorochemicals, pyridinium compounds, carboxymethyl compounds, and organosilicone compounds as the water-repellent and oil-repellent treatment.

6. The method of claim 1 including applying an aqueous composition containing hydroxyl ethyl amine as the absorbency-enhancing treatment.

7. The method of claim 1 including applying a composition containing organic fluorinated polyacrylates as the soil-release treatment.

8. The method of claim 1 including curing and drying the first, second, and third lots by conveying the first, second, and third lots sequentially through at least one oven under substantially constant process conditions.

9. A garment made by a method including:

a) conveying first, second, and third lots of greige fabric through singeing, desizing, scouring, bleaching, and mercerizing processes;

b) holding the first lot in a stretched condition on tentering means and applying a water-repellent and oil-repellent treatment to the first lot;

c) holding the second lot in a stretched condition on tentering means and applying an absorbency-enhancing treatment to the second lot;

d) holding the third lot in a stretched condition on tentering means and applying a soil-release treatment to the third lot;

e) curing and drying the first, second, and third lots;

f) cutting, from the first lot, a front portion of a garment for covering a front side of a wearer's torso;

g) cutting, from the second lot, a pair of sleeve portions and a back portion of a garment for covering a back side of a wearer's torso;

h) cutting, from the third lot, a collar portion and a pair of cuff portions, and i) sewing together the front and back portions, the sleeve portions, the cuff portions and the collar portion to form the garment.

10. The garment made according to the method of claim 9, further including holding the first, second, and third lots in a stretched condition on tentering means and applying a wrinkle-free treatment to each of the first, second, and third lots.

11. The garment made according to the method of claim 10, further including applying a composition including dihydroxymethyl cyclic urea as the wrinkle-free treatment.

12. The garment made according to the method of claim 10, further including applying the water-repellent and oil-repellent absorbency-enhancing, the absorbing-enhancing, and soil-release treatments by saturation or impregnation in an aqueous treatment liquor.

13. The garment made according to the method of claim 10, further including applying a composition containing compounds selected from the group consisting of fluorochemicals, pyridinium compounds, carboxymethyl compounds, and organosilicone compounds as the water-repellent and oil-repellent treatment.

14. The garment made according to the method of claim 10, further including applying a composition containing compounds selected from the group consisting of fluorochemicals, pyridinium compounds, carboxymethyl compounds, and organosilicone compounds as the water-repellent and oil-repellent treatment, applying an aqueous composition containing hydroxyl ethyl amine as the absorbency-enhancing treatment.

15. The garment made according to the method of claim 10, further including applying a composition containing organic fluorinated polyacrylates as the soil-release treatment.

* * * * *

UNITED STATES PATENT AND TRADEMARK OFFICE

CERTIFICATE OF CORRECTION

PATENT NO. : 7,841,022 B2
APPLICATION NO. : 12/173182
DATED : November 30, 2010
INVENTOR(S) : Jianxiang Zhang It is certified that error appears in the above-identified patent and that said Letters Patent is hereby corrected as shown below:

On the title page item (75) Inventors: Change "Jason Chang" to --Jianxiang Zhang--.

Signed and Sealed this
Twenty-eighth Day of June, 2011

David J. Kappos

David J. Kappos
*Director of the United States Patent and Trademark Office*